US006368015B1

(12) United States Patent
Bitelli

(10) Patent No.: US 6,368,015 B1
(45) Date of Patent: Apr. 9, 2002

(54) VIBRATORY FINISHING MACHINE

(75) Inventor: Romolo Bitelli, S. Lazarro (IT)

(73) Assignee: Bitelli SPA, Minerbio (IT)

( * ) Notice: Subject to any disclaimer, the term of this patent is extended or adjusted under 35 U.S.C. 154(b) by 0 days.

(21) Appl. No.: 09/489,902

(22) Filed: Jan. 24, 2000

(30) Foreign Application Priority Data

Feb. 1, 1999 (IT) ..... VI990007 U

(51) Int. Cl.[7] ..... E01C 19/12; E01C 19/22
(52) U.S. Cl. ..... 404/101; 404/114; 404/118
(58) Field of Search ..... 404/101, 102, 404/104, 105, 106, 108, 110, 113, 114, 115, 118, 120, 119, 81, 82, 84.1, 84.8, 86, 91; 460/71, 72

(56) References Cited

U.S. PATENT DOCUMENTS 3,967,912 A * 7/1976 Parker ..... 404/84
4,466,757 A * 8/1984 Allen ..... 404/114
4,741,643 A * 5/1988 Allen ..... 404/114
4,749,304 A * 6/1988 Craig ..... 404/101
4,823,366 A * 4/1989 Willis ..... 404/101
5,232,305 A 8/1993 Bassett ..... 404/101

FOREIGN PATENT DOCUMENTS

EP 0 495 171 A1 11/1991

* cited by examiner

*Primary Examiner*—Thomas B. Will
*Assistant Examiner*—Raymond Addie
(74) *Attorney, Agent, or Firm*—Dykema Gossett PLLC

(57) ABSTRACT

The finding produces a self-propelled vibratory finishing machine for asphalting road surfaces comprising a frame which supports a storage device and distribution of the bitumen to be deposited on the surfaces comprising a pair of screw feeders moved by a transmission unit and a pressing device the deposited bitumen aggregate set behind the screw feeders. Connected to the transmission unit and next to the screw feeders there is a flow divider device having surfaces symmetrically shaped to create at least one cutting edge suited to aid the flow of bitumen towards the screw feeders.

10 Claims, 5 Drawing Sheets

VIBRATORY FINISHING MACHINE

This finding concerns a vibratory finishing machine especially suited for uniformly depositing bitumen aggregate on surfaces to be asphalted. It is known that in road asphalting work common use is made of self-propelled machines called vibratory finishing machines which basically consist of a frame shaped to provide a driver's cab and which houses the means of traction of the machine itself.

What's more the frame also holds a hopper with mobile walls containing the hot bitumen aggregate that, when retrieved by a conveyor belt, is deposited on the surface being asphalted.

The bitumen aggregate is then uniformly spread onto the surface being asphalted by the action of a pair of screw feeders standing side by side and set crossways to the machine's direction of travel and rotated by a transmission unit that connects them next to the machine's centreline. While the bitumen aggregate is still hot it is uniformly spread over the road surface being asphalted and then compacted by the action of a device called a "vibrating compactor" set behind the screw feeders with respect to the machine's direction of travel.

The vibratory compactor comprises a plowshare consisting of a plate having a primarily longitudinal direction, set perpendicular to the surface being asphalted and crossways to the machine's direction of travel. In particular the plowshare spreads the bitumen aggregate distributed by the screw feeders thereby preparing it for compacting by a beam, which is also set crossways to the machine's direction of travel and made to oscillate vertically by a device connected to it.

The main inconvenience of the machine described above is that the flow of bitumen aggregate transported by the conveyor belt engulfs the space between the screw feeders and the plowshare creating a build up of bitumen aggregate against the transmission unit which leads to an uneven distribution of the bitumen aggregate on the road course, thereby requiring additional finishing by hand.

This build up is also aggravated by the machine's forward travel that pushes the bitumen aggregate against the plate. Another inconvenience is that the build up of bitumen aggregate tends to cool and thereby consolidates, hampering the uniform distribution of bitumen aggregate on the surface being asphalted. This makes it necessary to remove the consolidated bitumen aggregate, which has to be carried out periodically by an operator who has to follow the machine throughout the work cycle. Last but not least, an inconvenience is caused by the risk the operator runs while removing the consolidated bitumen aggregate, since he has to remove the bitumen aggregate with a spade in close proximity to the rotating screw feeders.

This finding intends to remedy the aforementioned inconveniences. The main scope of the finding is to produce a machine that allows to deposit the bitumen coarse in an even, uniform manner over the whole surface being treated.

Last but not least, a scope is to produce a machine that eliminates the build-up of hot bitumen aggregate and its consequent cooling. Another scope is to produce a machine that does not require the intervention of operators during the work cycle.

The aforesaid scopes are achieved by a self-propelled vibratory finishing machine for asphalting road surfaces that in accordance with the main claim comprises a frame, housing a means of traction, which is shaped to provide a driver's cab and that supports:

storage means and distribution of the bitumen aggregate ready to be deposited on said surfaces comprising a pair of screw feeders working side by side mounted crossways to the direction of travel of said machine, moved by a transmission unit that connects them next to the machine's centreline;

pressing means the deposited bitumen aggregate set behind said screw feeders and crossways to the direction of travel of said machine;

that is characterised in that it has, connected to said transmission unit and next to said screw feeders, a flow divider device basically consisting of faces symmetrically shaped around a vertical axis, converging towards said axis to create at least one cutting edge suited to aid the flow of bitumen aggregate towards said screw feeders.

An advantage of the finding is that it allows a uniform distribution of the bitumen aggregate deposited on the surface being asphalted. Another advantage of the finding is that it allows a vibratory finishing machine to be produced that does not require periodical servicing by operators to guarantee an even deposit of bitumen aggregate.

The aforesaid scopes and advantages shall be better explained during the description of a preferred form of execution of the finding given as a guideline but not a limitation and illustrated in the attached diagrams, where:

Figure 1:
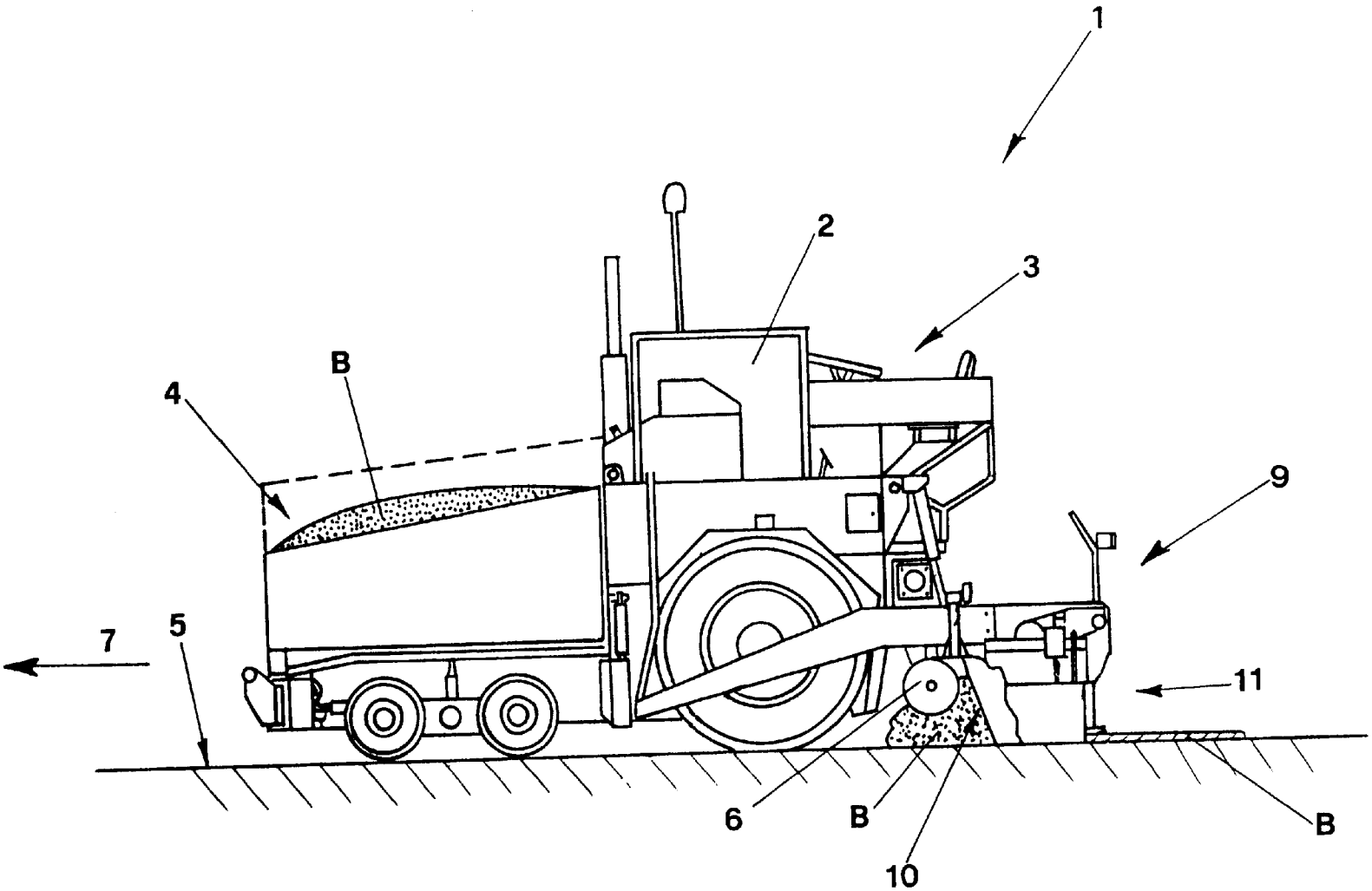
FIG. 1 illustrates the vibratory finishing machine under this finding.
Figure 2:
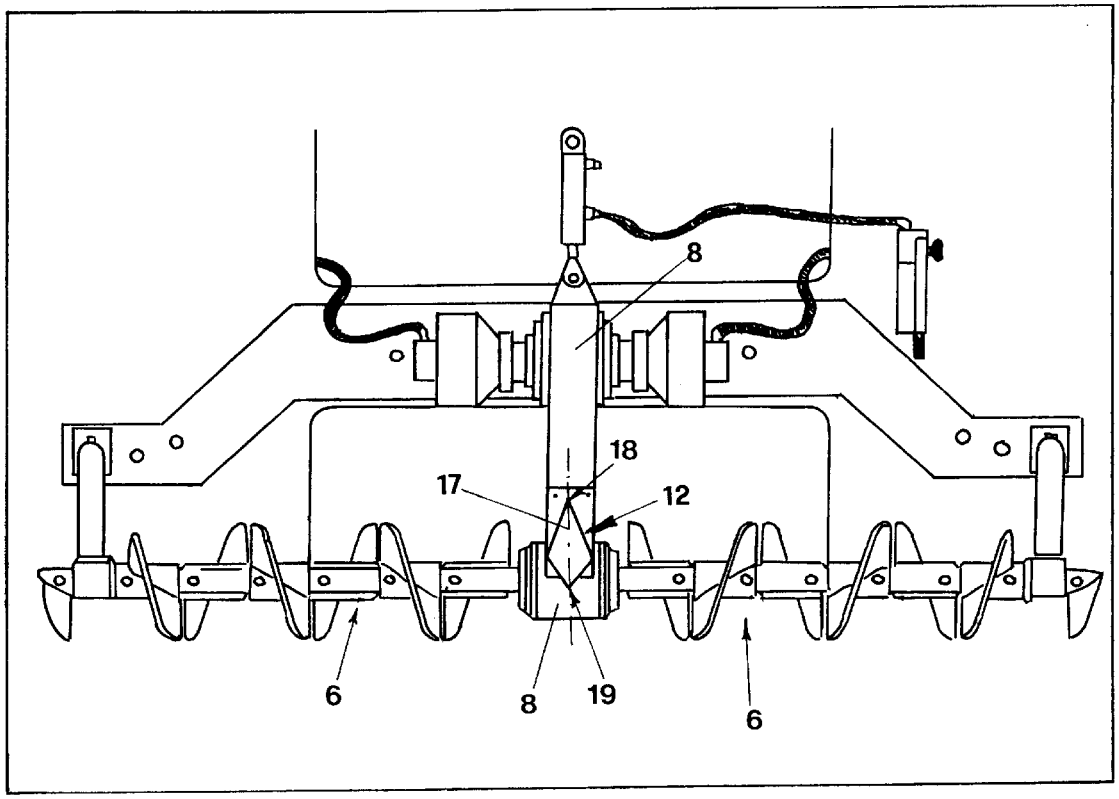
FIG. 2 illustrates a front view of part of the vibratory finishing machine in FIG. 1.

The vibratory finishing machine under this finding is illustrated in FIG. 1, where it is indicated as a whole by 1. It essentially comprises a frame 2, which is shaped to provide a driver's cab 3 and that houses the machine's means of traction. The frame 2 also supports storage means consisting of a mobile walled hopper 4 containing the hot bitumen aggregate B that is retrieved by a conveyor belt, not illustrated, to be deposited on the surface being asphalted 5. The deposited aggregate B is then uniformly distributed onto the surface being asphalted 5 by the action of a pair of screw feeders 6 standing side by side, set to the rear of the machine 1 and crossways to the direction of travel 7 of the machine 1, moved by a transmission unit 8, illustrated in detail in FIG'S. 2 and 3, that connects them next to the machine's centreline 1.

The bitumen aggregate B is then compacted by a device, called a vibratory compactor generally indicated by 9 in FIG. 1, set behind the screw feeders 6, with respect to the direction of travel 7 of the machine 1.

The vibratory compactor 9 comprises a plowshare consisting of a plate 10 having a primarily longitudinal direction set perpendicular to the surface 5 being asphalted and crossways to the direction of travel 7 of the machine 1. The plowshare spreads the bitumen aggregate B distributed by the screw feeders 6 and prepares it for compacting by an oscillating beam 11, also mounted crossways to the direction of travel 7 of the machine 1, made to oscillate vertically by a device connected to it and not illustrated.

Figure 4:
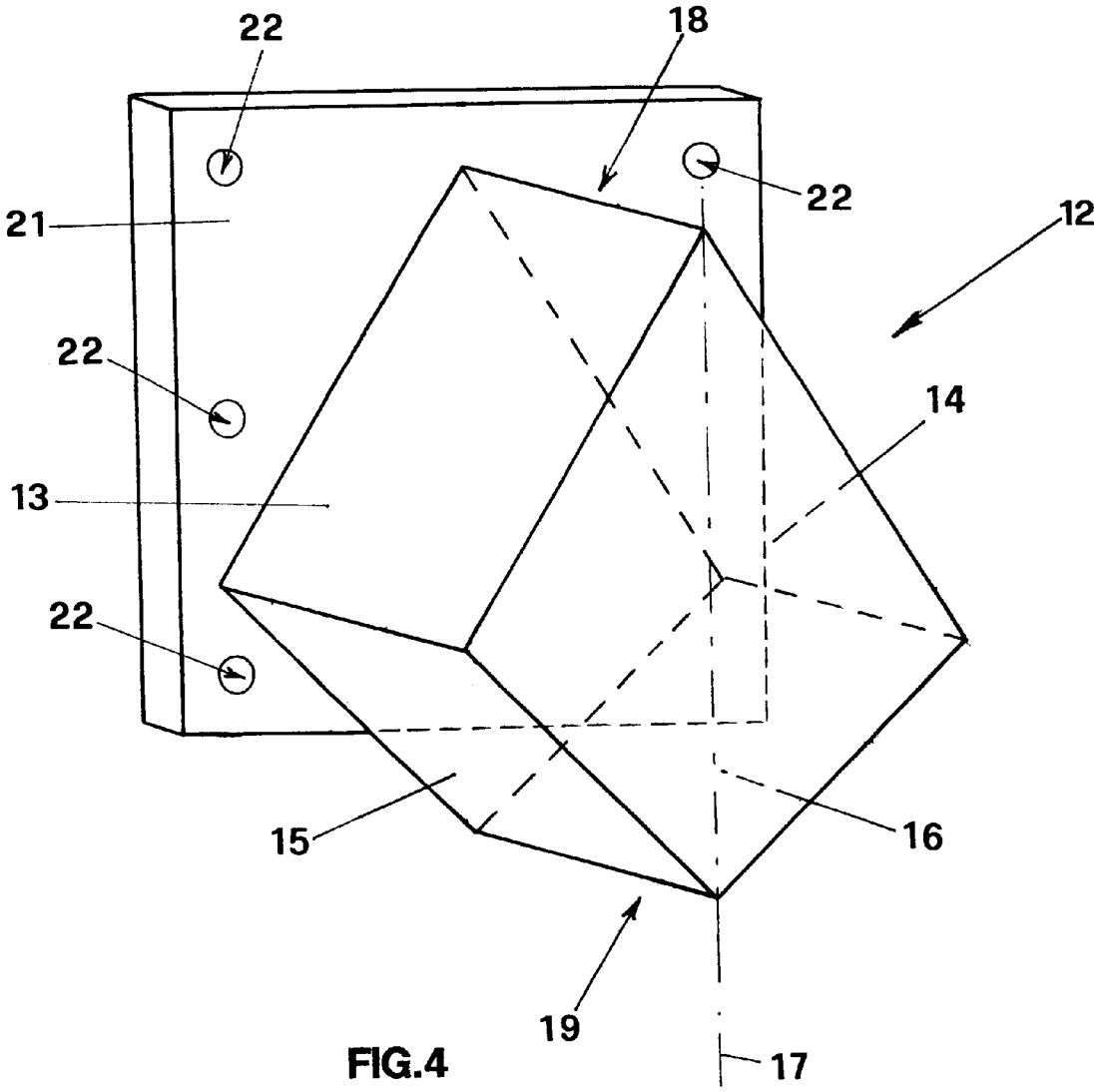
FIG. 4 illustrates an isometric view of a detail of the machine in FIG. 1.
Figure 5:
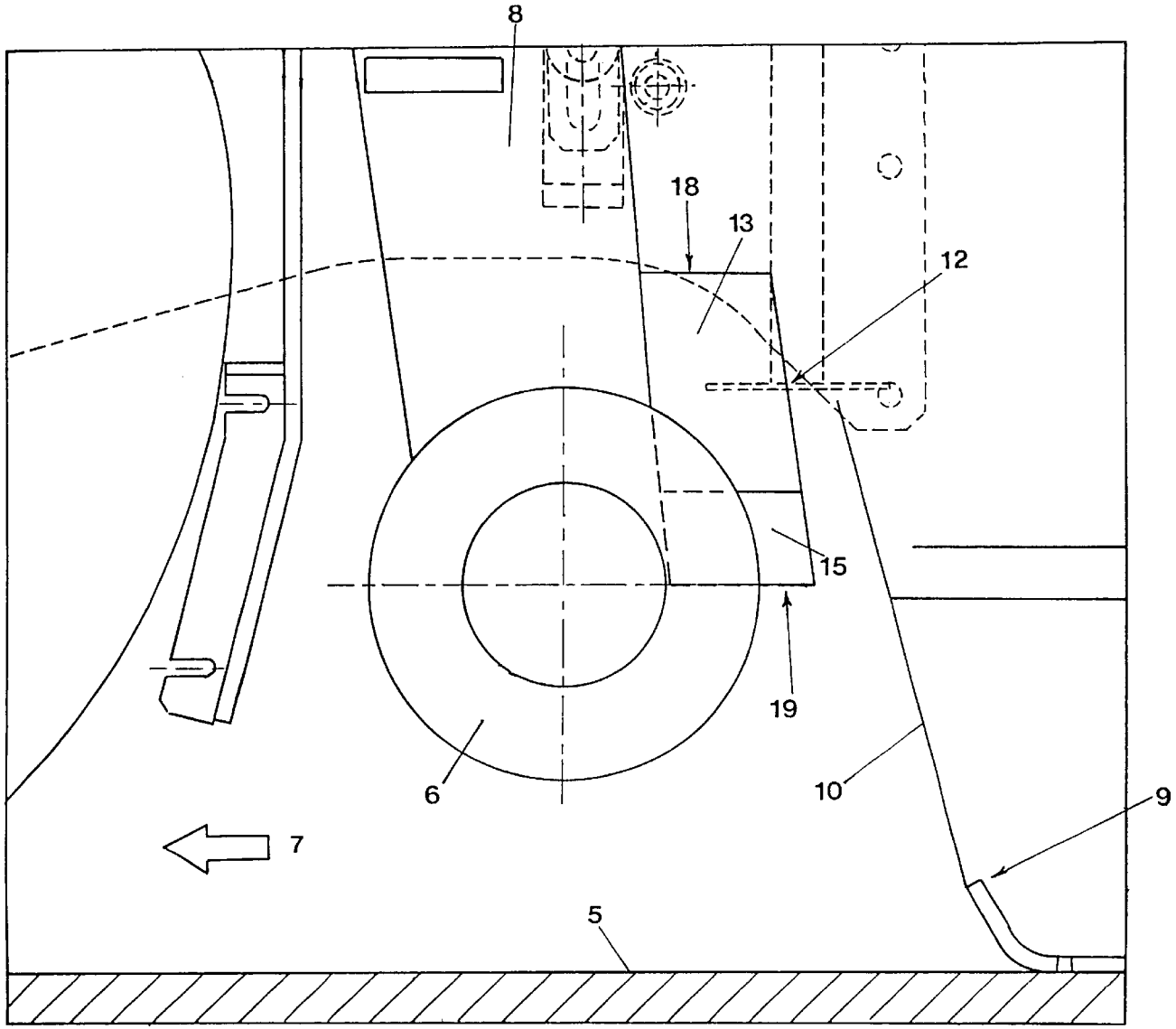
FIG. 5 illustrates a side view of part of the machine in FIG. 1.

The finding prescribes that the transmission unit 8 is connected, next to the screw feeders 6, to a flow divider device 12 having a basically prismatic form and symmetrical around an axis 17, as illustrated in FIG. 4, having surfaces 13 and 14, 15 and 16 converging towards the symmetrical axis 17 so that a top cutting edge 18 and bottom cutting edge 19 are created. A plate 21, connected to the flow divider device 12, having a series of through holes 22 enables it, by a means of fixing such as screws or similar not illustrated, to be applied to the transmission unit 8.

Figure 3:
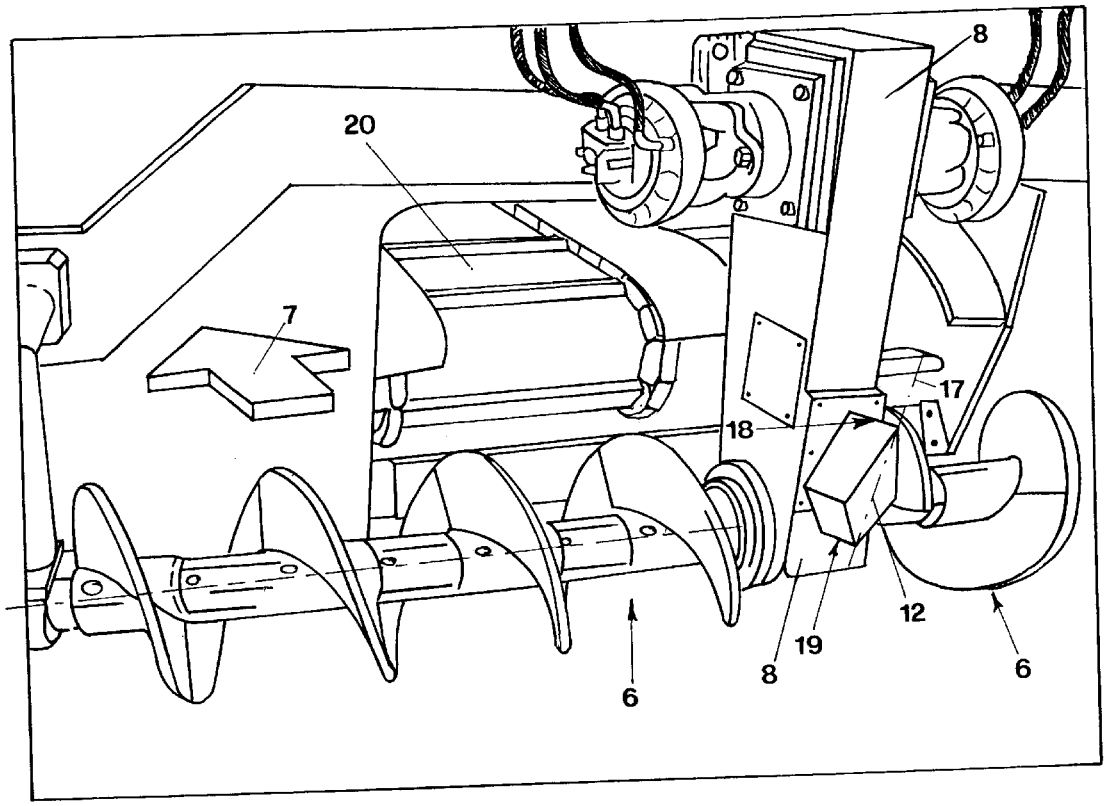
FIG. 3 illustrates an isometric view of a detail of the machine in FIG. 1.

The bitumen aggregate B that is transported by the conveyor belt 20, as can be seen in detail in FIG. 3, falls by gravity towards the surface being asphalted 5, and encounters the top cutting edge 18 and surfaces 13 and 14 which prevent any build ups and aid the flow of bitumen aggregate B towards the screw feeders 6.

The build up of bitumen aggregate B around the transmission unit 8 caused by the machine's travel is prevented in a similar manner by the action of surfaces 15, 16 and the bottom cutting edge 19. In this way, the flow of bitumen aggregate B never encounters blind zones where it may settle, cool and consolidate, since it is continuously directed in motion, by the combined action of gravity and the machine's travel towards the screw feeders 6, which by rotating spread the bitumen aggregate B sideways. It is clear that the flow divider device 12 may take on any form, having curved surfaces and more; so long as the shape and position are such that the deposited bitumen aggregate B is kept mixed.

In a similar way, any quantity of these flow divider devices 12 may be mounted on the machine 1 as their size may differ.

What is claimed is:

1. A vibratory, self-propelled finishing machine for laying a bitumen aggregate on a road surface comprising:

a means of traction;

a frame, said frame being shaped to provide a driver's cab and to house said means of traction;

a storage means for storage of said bitumen aggregate to be deposited on said road surface;

a distribution means for the distribution of said bitumen aggregate to be deposited on said road surface, said distribution means comprising a pair of screw feeders positioned side by side and transversely to the direction of travel of said machine;

a transmission unit for moving said pair of screw feeders, said transmission unit connecting said pair of screw feeders next to the machine's centerline;

pressing means for compacting said bitumen aggregate deposited on said road surface, said pressing means being positioned behind said pair of screw feeders and transversely with respect to the direction of travel of said machine; and a flow divider device connected to said transmission unit on a side of said transmission unit that faces towards said pressing means and at a location next to said pair of screw feeders, said flow divider device being shaped to aid a flow of bitumen aggregate towards said pair of screw feeders.

2. A vibratory finishing machine according to claim 1, wherein said flow divider device has surfaces symmetrically shaped around a vertical axis, converging towards said axis to create at least one cutting edge in the opposite direction to the flow of bitumen aggregate, said at least one cutting edge aids said flow of bitumen aggregate towards said pair of screw feeders.

3. A vibratory finishing machine according to claim 2, wherein said surfaces of said flow divider device converge to create a top cutting edge and a bottom cutting edge.

4. A vibratory finishing machine according to claim 3, wherein said flow divider device is a solid piece having a basically prismatic shape with bases of a rhombic form.

5. A vibratory finishing machine according to claim 1, wherein said flow divider device is connected to a plate, said plate connecting said flow divider device to said transmission unit.

6. A vibratory, self-propelled finishing machine for laying a bitumen aggregate on a road surface comprising:

a means of traction;

a frame, said frame being shaped to provide a driver's cab and to house said means of traction;

a storage means for the storage of said bitumen aggregate to be deposited on said road surface;

a distribution means for the distribution of said bitumen aggregate to be deposited on said road surface, said distribution means comprising a pair of screw feeders positioned side by side and transversely to the direction of travel of said machine;

a transmission unit for moving said pair of screw feeders, said transmission unit connecting said pair of screw feeders next to the machine's centerline;

pressing means for compacting said bitumen aggregate deposited on said road surface, said pressing means being positioned behind said pair of screw feeders and transversely with respect to the direction of travel of said machine; and a flow divider device connected to said transmission unit on a side of said transmission unit that faces towards said pressing means and at a location next to said pair of screw feeders, said flow divider device being shaped to aid a flow of bitumen aggregate towards said pair of screw feeders;

said flow divider device having surfaces symmetrically shaped around a vertical axis, converging towards said axis to create at least one cutting edge in the opposite direction to the flow of bitumen aggregate, said at least one cutting edge aiding said flow of bitumen aggregate towards said pair of screw feeders.

7. A vibratory finishing machine according to claim 6, wherein said surfaces of said flow divider device converge to create a top cutting edge and a bottom cutting edge.

8. A vibratory finishing machine according to claim 7, wherein said flow divider device is a solid piece having a basically prismatic shape with bases of a rhombic form.

9. A vibratory finishing machine according to claim 6, wherein said flow divider device is connected to a plate, said plate connecting said flow divider device to said transmission unit.

10. A vibratory, self-propelled finishing machine for laying a bitumen aggregate on a road surface comprising:

a means of traction;

a frame, said frame being shaped to provide a driver's cab and to house said means of traction;

a storage means for the storage of said bitumen aggregate to be deposited on said road surface;

a distribution means for the distribution of said bitumen aggregate to be deposited on said road surface, said distribution means comprising screw feeders positioned side by side and transversely to the direction of travel of said machine;

a transmission unit for moving said screw feeders, said transmission unit connecting said screw feeders;

pressing means for compacting said bitumen aggregate deposited on said road surface, said pressing means being positioned behind said screw feeders and transversely with respect to the direction of travel of said machine; and at least one flow divider device connected to said transmission unit on a side of said transmission unit that faces towards said pressing means and at a location next to said screw feeders, said flow divider device being shaped to aid a flow of bitumen aggregate towards said screw feeders.

* * * * *